US010634372B2

(12) United States Patent
Couperthwaite et al.

(10) Patent No.: US 10,634,372 B2
(45) Date of Patent: Apr. 28, 2020

(54) DUAL-STAGE HUMIDIFIER METHODS AND SYSTEMS

(71) Applicant: Condair Group AG, Pfäffikon/SZ (CH)

(72) Inventors: Scott Couperthwaite, Ottawa (CA); Shahram Lotfi, Orleans (CA)

(73) Assignee: Condair Group AG (CH)

( * ) Notice: Subject to any disclaimer, the term of this patent is extended or adjusted under 35 U.S.C. 154(b) by 238 days.

(21) Appl. No.: 15/621,442

(22) Filed: Jun. 13, 2017

(65) Prior Publication Data

US 2017/0356663 A1 Dec. 14, 2017

Related U.S. Application Data

(60) Provisional application No. 62/349,237, filed on Jun. 13, 2016.

(51) Int. Cl.
*F24F 6/18* (2006.01)
*F28F 13/06* (2006.01)
(Continued)

(52) U.S. Cl.
CPC ..... *F24F 6/18* (2013.01); *F04B 19/006* (2013.01); *F24F 6/02* (2013.01); *F28F 13/06* (2013.01); *F24F 2006/008* (2013.01)

(58) Field of Classification Search
CPC ..... F24F 6/02; F24F 6/18; F24F 2006/008; F24F 2221/34; F04B 19/006; F28F 13/06
See application file for complete search history.

(56) References Cited

U.S. PATENT DOCUMENTS 2,328,538 A 9/1943 Furlong
3,801,077 A * 4/1974 Pearson ..... F24F 6/18 261/139
(Continued)

FOREIGN PATENT DOCUMENTS

CN 101029758 A * 9/2007
CN 103328031 A * 9/2013 ..... A61M 16/1075
(Continued)

OTHER PUBLICATIONS

CN101029758A, Multi-point atomizing central air-conditioner without nozzle, Tu (Year: 2007).*
(Continued)

*Primary Examiner* — Cassey D Bauer
*Assistant Examiner* — Kirstin U Oswald
(74) *Attorney, Agent, or Firm* — Akerman LLP

(57) ABSTRACT

A humidifier includes a burner for burning fuel within a water tank for generating steam, a primary heat exchanger within the water tank for transferring heat from products of combustion of the fuel to the water within the water tank, and a secondary heat exchanger. The secondary heat exchanger includes a combusted gas section for receiving the cooled products of combustion from the primary heat exchanger and a water section for transferring additional heat from the cooled products of combustion to water flowing within the secondary heat exchanger. The humidifier further includes a secondary fill valve which is pulsed to provide cool water for transferring additional heat from the cooled products of combustion to water flowing within the secondary heat exchanger. The water from a primary fill valve is fed directly into the water tank. An outlet of the secondary heat exchanger is fed directly into the water tank.

17 Claims, 8 Drawing Sheets

(51) Int. Cl.

| | |
|---|---|
| ***F24F 6/02*** | (2006.01) |
| ***F04B 19/00*** | (2006.01) |
| *F24F 6/00* | (2006.01) |

(56) References Cited

U.S. PATENT DOCUMENTS 4,054,122 A 10/1977 Reed
5,203,500 A * 4/1993 Horne, Sr. ..... F24D 17/00 122/13.3
5,349,946 A * 9/1994 McComb ..... A61M 16/1075 128/203.12
5,816,496 A * 10/1998 Kovacs ..... F22B 13/005 237/78 R
5,904,836 A * 5/1999 Lee ..... C10G 9/00 208/97
5,983,889 A * 11/1999 Thomas ..... F24H 1/0054 119/73
6,370,878 B1 * 4/2002 Dean ..... H01M 8/04022 60/649
2001/0020451 A1 * 9/2001 Besik ..... F22B 1/18 122/367.1
2003/0016952 A1 * 1/2003 Elphee ..... F22B 1/284 392/324
2006/0249099 A1 11/2006 Besik
2009/0255323 A1 * 10/2009 Butt ..... H01M 8/04007 73/29.02
2013/0186748 A1 * 7/2013 Yoon ..... F24F 6/12 204/229.4
2015/0202563 A1 * 7/2015 Spartz ..... B01D 53/1412 95/25
2017/0334736 A1 * 11/2017 Lam ..... B01D 1/14

FOREIGN PATENT DOCUMENTS

EP 1260772 A1 * 11/2002 ..... F24F 6/00
KR 100816042 B1 * 3/2008

OTHER PUBLICATIONS

CN-103328031-A, Humidifier, Bath (Year: 2013).*
KR-100816042-B1, Heat recovery ventilation with dual circuit heat pump, Kim (Year: 2008).*
European Search Report issued in corresponding European Patent Application No. 17 00 0919 dated Jan. 18, 2018.

* cited by examiner

DUAL-STAGE HUMIDIFIER METHODS AND SYSTEMS

CROSS-REFERENCE TO RELATED APPLICATIONS

This patent application claims the benefit of U.S. Provisional Patent Application 62/349,237 filed on Jun. 13, 2016 entitled "Dual-Stage Humidifier Methods and Systems", the entire contents of which are incorporated herein by reference.

FIELD OF THE INVENTION

This invention relates to humidifiers and more particularly to the design of high efficiency two-stage heat exchangers within humidifiers and their control.

BACKGROUND OF THE INVENTION

A humidifier is a device that increases humidity (moisture) in a single room or an entire building. Point-of-use humidifiers are commonly used to humidify a single room, while whole-house or furnace humidifiers, which connect to a building's home's heating, ventilation and air conditioning (HVAC) system, provide humidity to the building. Large humidifiers are used in commercial, institutional, or industrial contexts, often as part of a large HVAC system.

The need for humidifiers arises in low humidity environments which may occur in hot, dry desert climates, or indoors in artificially heated spaces. In winter, especially when cold outside air is heated indoors, the humidity may drop as low as 10-20%. This low humidity can cause adverse health effects for humans and animals within these environments either as workers, visitors, or residents. Industrial humidifiers may also be used when a specific humidity level must be maintained to achieve specific requirements such as preventing static electricity buildup or preserving material properties (e.g. art galleries, museums, libraries, and their associated storage).

Whilst evaporative humidifiers, natural humidifiers, vaporizing humidifiers, impeller humidifiers and ultrasonic humidifiers are all common types, it is the vaporizing humidifier (or vaporizer, steam humidifier, warm mist humidifier) that dominates the industry for most commercial humidification systems. These operate by heating or boiling water, releasing steam and thereby moisture into the air. However, today the vaporizing humidifier must achieve its desired function and operate with what are quite often conflicting requirements arising from different factors such as cost of ownership (CoO) and regulatory guidelines. From the CoO perspective owners seek high injection efficiency (so that the desired humidity within the air flow is achieved with minimal steam losses to condensate) together with low water consumption, and high energy efficiency to reduce energy consumption and running costs. Further, for low CoO the vaporizing humidifier should be high reliability, low maintenance, and simple to repair. Further, all of this is sought with variable humidification as the humidity level in an air flow unless it is dried first will vary throughout the day and through the year such that the humidity demand may range from nothing to all the desired level. Finally, the humidifier when exploiting a heat exchanger between a combusted material (e.g. natural gas, oil, etc.) should have low exhaust gas temperatures both from a safety/regulatory viewpoint but also from the desire to use reducing installation cost by using low temperature plastics for ducting/venting of the exhaust gases and high efficiency.

To date vaporizing humidifiers have been partially successful at achieving these requirements because they have utilized only a single stage heat exchanger that could not extract latent energy from exhaust gases because the secondary fluid is boiling water. The high temperature of the exhaust required use of high temperature stainless steel exhaust venting and resulted in potentially useful energy being simply exhausted into the atmosphere.

Accordingly, it would be beneficial to provide designs of dual-stage humidification systems with an effective design for achieving the conflicting objectives under variable humidification operation as well as addressing the control loop design of such dual-stage humidification systems.

Other aspects and features of the present invention will become apparent to those ordinarily skilled in the art upon review of the following description of specific embodiments of the invention in conjunction with the accompanying figures.

SUMMARY OF THE INVENTION

Today vaporizing humidifier must achieve their desired function and operate with conflicting requirements such as cost of ownership (CoO) and regulatory guidelines. Low CoO requires high injection efficiency, low water consumption, and high energy efficiency to reduce energy consumption and running costs. All of this is sought with variable humidification and low exhaust gas temperatures from safety/regulatory viewpoints as well as ducting material selection and venting of the exhaust gases and high efficiency. To date vaporizing humidifiers have been partially successful utilizing a single stage heat exchanger that could not extract latent energy from exhaust gases because the secondary fluid is boiling water. High exhaust temperature requires high temperature stainless steel exhaust venting. Embodiments of the invention provide dual-stage humidification systems with an effective design for achieving the conflicting objectives under variable humidification operation as well as addressing the control loop design of such dual-stage humidification systems.

It is an object of the present invention to mitigate limitations within the prior art relating to humidifiers and more particularly to the design of high efficiency two-stage heat exchangers within humidifiers and their control.

In accordance with an embodiment of the invention there is provided a humidifier comprising:

- a burner for burning a fuel within a water tank for generating steam in response to a demand;
- a primary heat exchanger within the water tank for transferring heat from products of combustion of the fuel to the water within the water tank;
- a secondary heat exchanger comprising a combusted gas section coupled to primary heat exchanger for receiving the cooled products of combustion from the primary heat exchanger and a water section for transferring additional heat from the cooled products of combustion at an output of the primary heat exchanger to water flowing within the secondary heat exchanger from a fill box to the water tank;

the fill box comprising:

- a first water tank chamber coupled to a primary water fill from an external water source via a primary water fill valve in order to maintain cool water in the chamber;
- a first outlet coupled from the first water tank chamber to the secondary heat exchanger via a micropump;

a second outlet coupled to a drain via a drain valve, wherein the drain also coupled the bottom of the water tank;

a second water tank chamber coupled to the bottom section of the water tank that contains floats which are used to control water level in the water tank; and a third outlet coupled to the upper section of the water tank to maintain pressure balance between the water tank and first water tank chamber.

In accordance with an embodiment of the invention there is provided a humidifier comprising:

a burner for burning a fuel within a water tank for generating steam in response to a demand;

a primary heat exchanger within the water tank for transferring heat from products of combustion of the fuel to the water within the water tank;

a secondary heat exchanger comprising a combusted gas section coupled to primary heat exchanger for receiving the cooled products of combustion from the primary heat exchanger and a water section for transferring additional heat from the cooled products of combustion to water flowing within the secondary heat exchanger from a fill box to the water tank; and a secondary fill valve connected to the secondary heat exchanger which is pulsed to provide cool water for transferring additional heat from the cooled products of combustion to water flowing within the secondary heat exchanger; wherein the fill box comprises:

a first water tank chamber coupled to a primary water fill from an external water source via a valve;

a first outlet coupled to a drain via a drain valve, the drain also coupled the bottom of the water tank;

a first inlet to the first water tank chamber coupled to the outlet of the secondary heat exchanger;

a second water tank chamber coupled to the bottom section of the water tank;

a plurality of floats which are used to control water level in the water tank;

a second outlet coupled to the upper section of the water tank to maintain pressure balance between the water tank and first water tank chamber.

In accordance with an embodiment of the invention there is provided a humidifier comprising:

a burner for burning a fuel within a water tank for generating steam in response to a demand;

a primary heat exchanger within the water tank for transferring heat from products of combustion of the fuel to the water within the water tank;

a secondary heat exchanger comprising a combusted gas section coupled to primary heat exchanger for receiving the cooled products of combustion from the primary heat exchanger and a water section for transferring additional heat from the cooled products of combustion to water flowing within the secondary heat exchanger from a fill box to the water tank; and a secondary fill valve connected to the secondary heat exchanger which is pulsed to provide cool water for transferring additional heat from the cooled products of combustion to water flowing within the secondary heat exchanger; wherein the water from a primary fill valve is fed directly into the tank; and an outlet of the secondary heat exchanger is fed directly into the tank.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

Embodiments of the present invention will now be described, by way of example only, with reference to the attached Figures, wherein.

DETAILED DESCRIPTION

Figure 1:
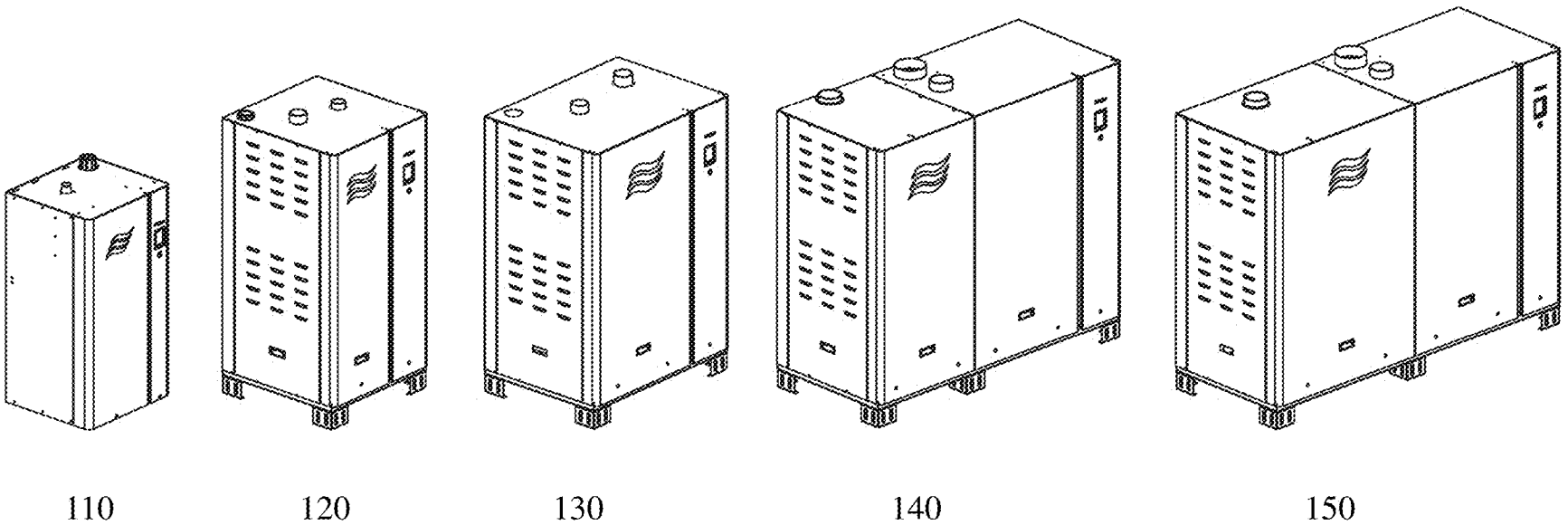
FIG. 1 depicts an example of a range of compact humidifiers.

The present invention is directed to humidifiers and more particularly to the design of high efficiency two-stage heat exchangers within humidifiers and their control.

The ensuing description provides representative embodiment(s) only, and is not intended to limit the scope, applicability or configuration of the disclosure. Rather, the ensuing description of the embodiment(s) will provide those skilled in the art with an enabling description for implementing an embodiment or embodiments of the invention. It being understood that various changes can be made in the function and arrangement of elements without departing from the spirit and scope as set forth in the appended claims. Accordingly, an embodiment is an example or implementation of the inventions and not the sole implementation. Various appearances of "one embodiment," "an embodiment" or "some embodiments" do not necessarily all refer to the same embodiments. Although various features of the invention may be described in the context of a single embodiment, the features may also be provided separately or in any suitable combination. Conversely, although the invention may be described herein in the context of separate embodiments for clarity, the invention can also be implemented in a single embodiment or any combination of embodiments.

Reference in the specification to "one embodiment", "an embodiment", "some embodiments" or "other embodiments" means that a particular feature, structure, or characteristic described in connection with the embodiments is included in at least one embodiment, but not necessarily all embodiments, of the inventions. The phraseology and terminology employed herein is not to be construed as limiting but is for descriptive purpose only. It is to be understood that where the claims or specification refer to "a" or "an" element, such reference is not to be construed as there being only one of that element. It is to be understood that where the specification states that a component feature, structure, or characteristic "may", "might", "can" or "could" be included, that particular component, feature, structure, or characteristic is not required to be included.

Reference to terms such as "left", "right", "top", "bottom", "front" and "back" are intended for use in respect to the orientation of the particular feature, structure, or element within the figures depicting embodiments of the invention. It would be evident that such directional terminology with respect to the actual use of a device has no specific meaning as the device can be employed in a multiplicity of orientations by the user or users. Reference to terms "including", "comprising", "consisting" and grammatical variants thereof do not preclude the addition of one or more components, features, steps, integers or groups thereof and that the terms are not to be construed as specifying components, features, steps or integers. Likewise, the phrase "consisting essentially of", and grammatical variants thereof, when used herein is not to be construed as excluding additional components, steps, features integers or groups thereof but rather that the additional features, integers, steps, components or groups thereof do not materially alter the basic and novel characteristics of the claimed composition, device or method. If the specification or claims refer to "an additional" element, that does not preclude there being more than one of the additional element.

An example of a range of commercial gas-fired humidifiers providing clean steam humidification with an economical operating cost is depicted in FIG. 1. Offered in condensing high-efficiency (CS), ultra-low NOX condensing (NX) and standard-efficiency models humidifiers with capacities ranging from 50 lb/h (23 kg/h) to 600 lb/h (270 kg/h). Standard efficiency units exploit just a primary heat exchanger whilst CS and NX variants employ a secondary heat exchanger to achieve the desired overall system performance. First to fifth humidifier models 110 to 150 respectively supporting:

First model 110: maximum capacities of 50 lb/h (~23 kg/h) or 100 lb/h (~45 kg/h);

Second model 120: maximum capacity of 150 lb/h (~65 kg/h);

Third model 130: maximum capacities of 200 lb/h (~90 kg/h) or 300 lb/h (~130 kg/h);

Fourth model 140: maximum capacity of 450 lb/h (~195 kg/h); and

Fifth model 150: maximum capacity of 600 lb/h (~260 kg/h).

These humidifiers are designed for humidification through the ducts in an air handling unit using a steam distributor or alternatively a steam distribution manifold as well as directly into a space with one or more blowers. Such humidifiers typically have an integrated controller board which not only controls the humidifier, but also allows the humidifier to be connected to a building automation system (e.g. BACnet, Lonworks, or Modbus) or the Internet so it can be controlled and monitored remotely. Further, humidifier designs allow multiple humidifiers to be combined using master-slave or main-extension configurations using linking/communications between the humidifiers directly or indirectly through building automation systems and/or Internet.

Referring to Table 1 there is listed a summary of the major components in each of first to fifth models 110 to 150 respectively to facilitate the range of humidification outputs from 50 lb/h (23 kg/h) to 600 lb/h (270 kg/h) respectively. Evident from Table 1 is that the design methodology of the steam based humidifier systems exploits multiple heat exchangers to provide higher steam output whilst reducing operating costs and meeting statutory requirements. However, other variants are possible such as a single primary heat exchanger with secondary heat exchangers of different size options for each, multiple primary heat exchangers with a single secondary heat exchanger, single primary heat exchanger with multiple secondary heat exchangers etc. The modular design concepts discussed and presented are not a requirement but one variant design methodology of many that may exploit embodiments of the invention.

TABLE 1

Components by Depicted Humidifier Model

| Component | Quantity | | | | |
|---|---|---|---|---|---|
| | First Model 110 | Second Model 120 | Third Model 130 | Fourth Model 140 | Fifth Model 150 |
| Steam Capacity (lb/h) | 50/100 | 150 | 300 | 450 | 600 |
| Primary Heat Exchanger | 1 | 1 | 2 | 3 | 4 |
| Secondary Heat Exchanger | 1 | 1 | 2 | 3 | 4 |
| Water Tank | 1 | 1 | 1 | 1 | 1 |
| Burner | 1 | 2 | 2 | 3 | 4 |
| Blower | 1 | 2 | 2 | 3 | 4 |
| Gas Valve | 1 | 2 | 2 | 3 | 4 |
| Ignition Control | 1 | 2 | 2 | 3 | 4 |
| Fill Box | 1 | 1 | 1 | 2 | 2 |
| Dual Fill Valve | 1 | 1 | 1 | 2 | 2 |
| Micropump | 1 | 1 | 2 | 3 | 4 |

Now referring to FIG. 2 there are depicted first and second views 200 and 250 of a humidifier according to an embodiments of the invention, e.g. second model 120 depicted in FIG. 1, are provided without the exterior panels allowing the major components to be identified which are listed in Table 2 below.

TABLE 2

Main Components of Humidifier System according to an Embodiment of the Invention

| | |
|---|---|
| 201 | Vent, exhaust |
| 202 | Hose, dual fill valve to fill box |
| 203 | Inlet, gas |
| 204 | Label, specification |
| 205 | Micropump |
| 206 | Inlet, dual fill valve |
| 207 | Switch, over-temperature |
| 208 | Heat-exchanger, secondary (CS/NX) |
| 209 | Port, drain |
| 210 | Port, condensate (CS/NX) |
| 211 | Trap, condensate (CS/NX) |
| 212 | Valve, manual drain |
| 213 | Panel, front |
| 214 | Hose, fill box to drain pump |
| 215 | Hose, fill box to water tank |
| 216 | Hose, float chamber to water tank |
| 217 | Fill box and float chamber |
| 218 | Switch, On/Off |
| 219 | Display, touchscreen |
| 220 | Hose, fill box overflow |
| 221 | Pump, drain |
| 222 | Cover, water tank |
| 223 | Tank, water |
| 224 | Spark-igniter and flame sensor |
| 225 | Combustion chamber and primary heat-exchanger |
| 226 | Module, ignition control |
| 227 | Assembly, blower |
| 228 | Inlet, air intake |

TABLE 2-continued

| Main Components of Humidifier System according to an Embodiment of the Invention | |
|---|---|
| 229 | Outlet, steam |
| 230 | Valve, gas |
| 231 | Terminal strip, low voltage |
| 232 | Board, integrated controller |
| 233 | Board, driver |

(Note:
(CS/NX) = CS and NX versions only)

Combustion: Within a high efficiency humidifier, the combustion system may consist of a fully modulating forced-draft combustion air blower(s), a negative pressure regulated gas valve(s), and a premix burner(s). On a call for humidity, the blower is energized to purge the system. During this time the control software performs diagnostic checks of the safety systems, such as the air proving switch (not shown) and the over-temperature switch, as well as the blowers. When the functions of the safety systems have been verified successfully, the gas valve(s) opens and the gas-air mixture is pushed through the burner ports into the combustion chamber(s). The spark-igniter(s) is simultaneously activated to ignite the gas-air mixture. If a flame is not sensed by the flame sensor(s) after a predetermined number of attempts, then the ignition control module(s) locks out and a fault message "Ignition Fail" generated. If a flame is sensed by the flame sensor(s), the gas valve(s) remains open and combustion continues. The gas valve(s) continues to maintain a constant air-to-gas ratio independent of the blower speed or external conditions. Within as discussed and depicted within this specification a standard efficiency humidifier the hot flue gases pass through the primary, in fact only, heat exchanger, and out to atmosphere. On the high efficiency CS and NX models, the hot flue gases pass through the primary heat-exchanger and then into a secondary heat-exchanger, wherein the flue gases are cooled further before exiting through the exhaust vent. The heat recovered by the secondary heat-exchanger is used to warm up the feed water. Optionally, another variant may be where the secondary heat exchanger and primary heat exchanger are essentially combined Water Management: Referring to FIG. 3 there is depicted a schematic of a humidifier such as depicted in FIG. 2 with the external water management aspects depicted. These are identified below in Table 3.

TABLE 3

| Water Management Components of a Humidifier System according to an Embodiment of the Invention | |
|---|---|
| 301 | Vent, air intake—connected to exterior (optional connection) |
| 302 | Steam line (rigid pipe) |
| 303 | Vent, exhaust |
| 304 | Valve, manual gas shutoff |
| 305 | Supply line, gas |
| 306 | Adaptor, breakout |
| 307 | Hose, steam |
| 308 | Distributor, steam (or absorption manifold) |
| 309 | Duct |
| 310 | Drain line, condensate (with trap) |
| 311 | Funnel (with trap) |
| 312 | Filter, Water (optional) |
| 313 | Valve, water shutoff |
| 314 | Supply line, water |
| 315 | Cables, power and control signal |

TABLE 3-continued

| Water Management Components of a Humidifier System according to an Embodiment of the Invention | |
|---|---|
| 316 | Drain line |
| 317 | Drain line, condensate (CS and NX models only) |

(Note:
(CS/NX) = CS and NX versions only)

According to an embodiment of the invention a humidifier is equipped with a combination fill box, float chamber, and water trap for connection to the train line. This combination fill box, float chamber and water trap is depicted as fill box and float chamber 217 (hereinafter fill box 217) in second view 250 of FIG. 2 and exploits innovative float chamber water level monitoring devices. The water trap is connected to a drain pump which is used to empty the main tank and perform drains to control mineral build up. All three components, namely fill box, float chamber, and water trap are essentially independent except the water trap and the float chamber share a common pressure balancing line to the top of the tank.

The innovative float chamber water level monitoring devices employ a pair of magnetic floats, main and backup, in order to measure multiple, for example five (5), water levels in the humidifier for proper operation. This float chamber and its control board are located away from the primary and secondary heat exchangers and any burners in order to increase reading accuracy and reduce mineral build-up within the fill box 217. The fill box 217 is connected to the water tank, e.g. water tank 223 (hereinafter tank 223) in first view 200 of FIG. 2, through four hoses. One hose connects to the bottom of the tank, and is used as the primary means to fill the tank 223. A second hose routes water through the secondary heat-exchanger, depicted as secondary heat-exchanger 208 (hereinafter SEC-HEX 208) in second view 250 of FIG. 2 into the tank (on CS and NX models only). A third hose runs from the float chamber to the tank allowing the water level within the tank 223 to be monitor using the magnetic floats. The final, fourth hose, connection is above water level in order to ensure equalization of pressure between the tank and float chamber.

The fill box 217 also includes an internal barrier structure to isolate the water within the tank from the water supply, as well as a vacuum breaker on top of the water trap. The vacuum breaker prevents siphoning when the drain pump is stopped. For example, this internal barrier structure is a 1" (25 mm) air gap although other structures may be employed with departing from the scope of the invention. As noted supra the float chamber provides monitoring of multiple levels for the control software of controller within the humidifier, e.g. integrated board 232 depicted in first view 200 of FIG. 2. Externally on the integrated display, e.g. touchscreen display 219 in second view 250 of FIG. 2, or a separate display these may be depicted through simple visual colour combinations of an LED array, discrete LEDs etc. or as a bar chart, visual image, etc. Considering the example of five (5) levels with three LEDs (red, green, yellow) then these would provide level indications as presented in Table 4 below.

TABLE 4

| Example of Level Indicators (5 Levels with 3 LEDs) | | | | |
|---|---|---|---|---|
| Level | Status | Red | Green | Yellow |
| L5 | High | | | X |
| L4 | Intermediate High | | X | X |
| L3 | Middle | | X | |

TABLE 4-continued

| Example of Level Indicators (5 Levels with 3 LEDs) | | | | |
|---|---|---|---|---|
| Level | Status | Red | Green | Yellow |
| L2 | Intermediate Low | X | X | |
| L1 | Low | X | | |

On initial start-up, dual fill valves fill the tank as well as the float chamber. The water level reaches the backup float first, then the main float. As water fills the float chamber and reaches the L1 level, the control software performs a series of tests to verify that the dual fill valves and drain pump function properly. During these tests, the dual fill valves continue to fill the tank until the water level reaches the L5 level in order to verify that all levels are detected correctly. Once the L5 level has been reached during start-up then the drain pump energizes in order to lower the water level to just below the L1 level. As the water level in the tank rises, if the float readings are inconsistent, a warning message "Float Inconsistent" is triggered and escalates to a subsequent fault message "Float Inconsistent Fault" if three consecutive inconsistencies occur. As the tests continue, if the water level does not rise to the L5 level, a fault message "Fill Check Fault" appears. Likewise, if the level does not drop just below the L1 level, the fault message "Drain Check" appears. When the tests are completed successfully, the dual fill valves energize again to fill the float chamber to either the L3 level or L4 level according to the controller software.

If a demand signal is present, indicating a need for steam (humidification) then the humidifier then begins the combustion sequence. A first fill valve has a high flow rate and is used to fill the tank quickly. The second fill valve has a low flow rate and is used to match steam production. Within some embodiments of the invention the second fill valve would be a modulating fill valve but in other embodiments may be a pulsed valve.

The low flow fill valve maintains the water level between L3 and L5. In normal operation the low flow valve is pulsed or modulated at a rate that will result in the water level increasing to L5. It must be pulsed/modulated to keep water in the fill box cool so that cool water is fed to the secondary from the fill box. If the water heats up then it will not cool the exhaust sufficiently to achieve condensing of exhaust gases. If the water level ever drops below L3 then the high flow valve is activated. When the pulsing/modulation results in water level reaching L5 then a drain is performed to remove minerals from the tank. On dual stage heat exchanger designs (e.g. CS and NX models) one or more micropumps are triggered periodically to cycle water through the SEC-HEX (s) into the tank.

During steam production, the control software activates a drain sequence, e.g. every 24 hours which itself adjustable as is the time of day it executes, in order to verify that the floats and drain pump are still functioning properly.

Figure 2:
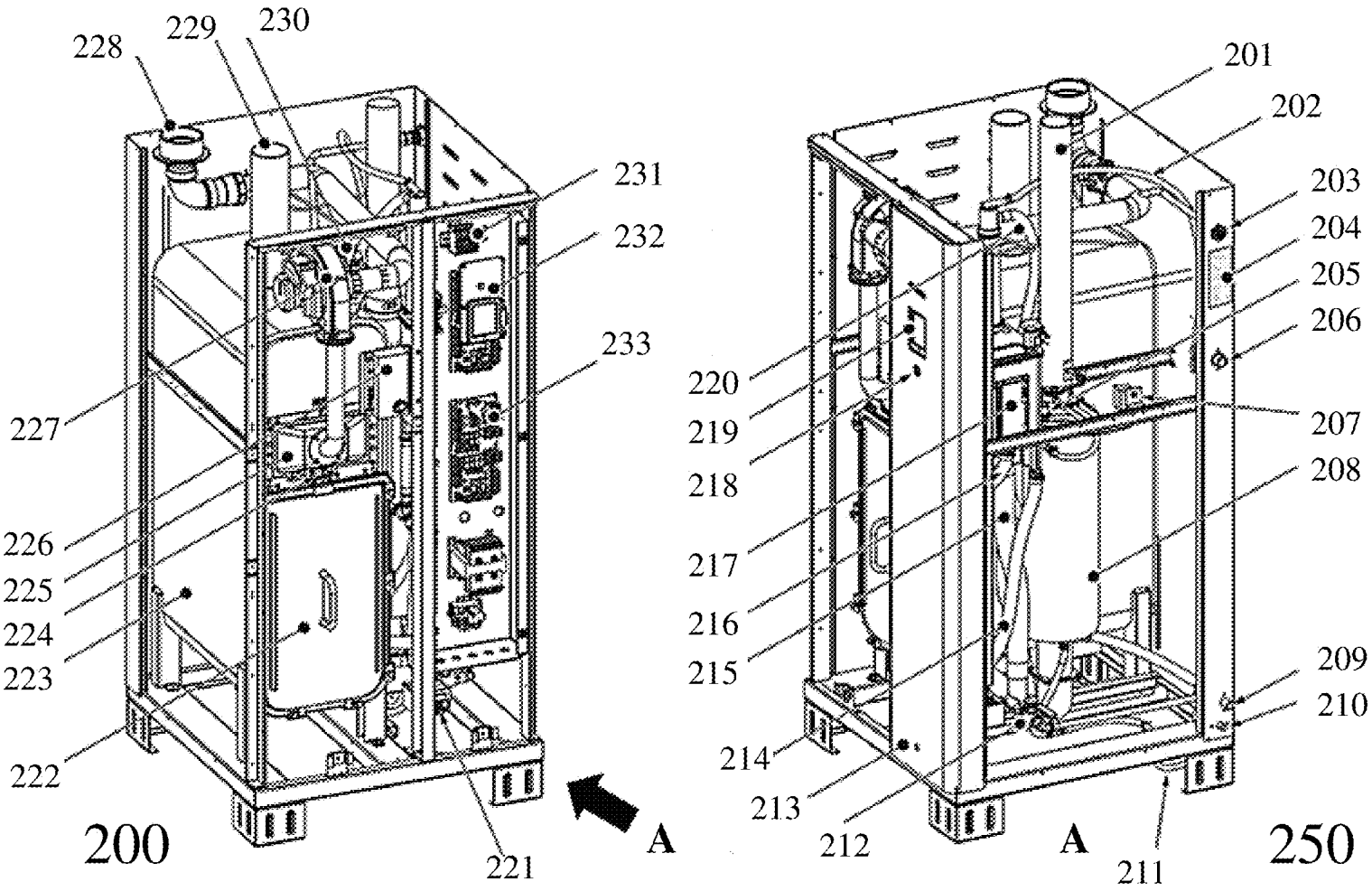
FIG. 2 depicts schematically from two viewpoints a compact high efficiency humidifier exploiting embodiments of the invention.
Figure 3:
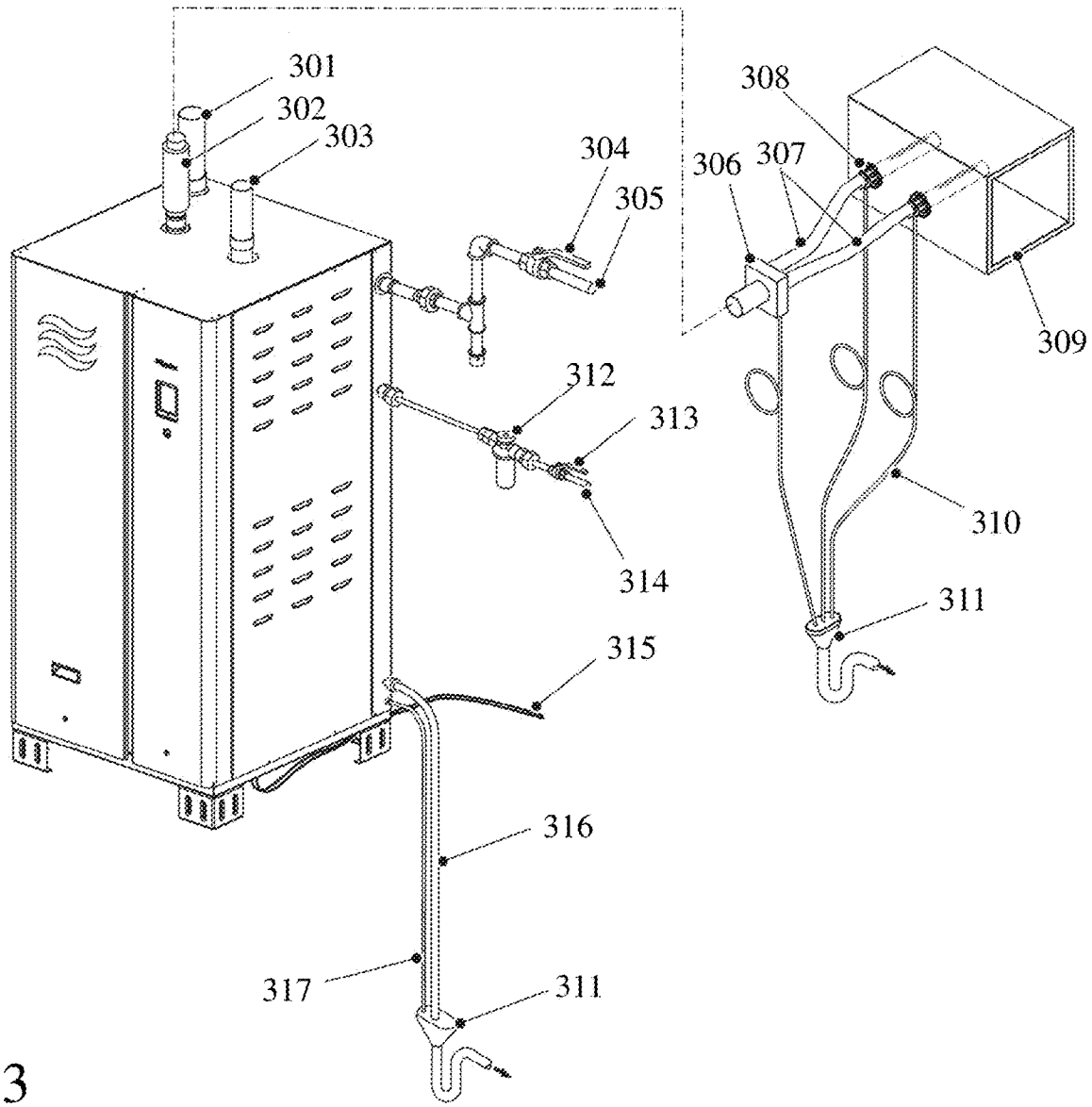
FIG. 3 depicts the external connections of a compact high efficiency humidifier exploiting embodiments of the invention.
Figure 4A:
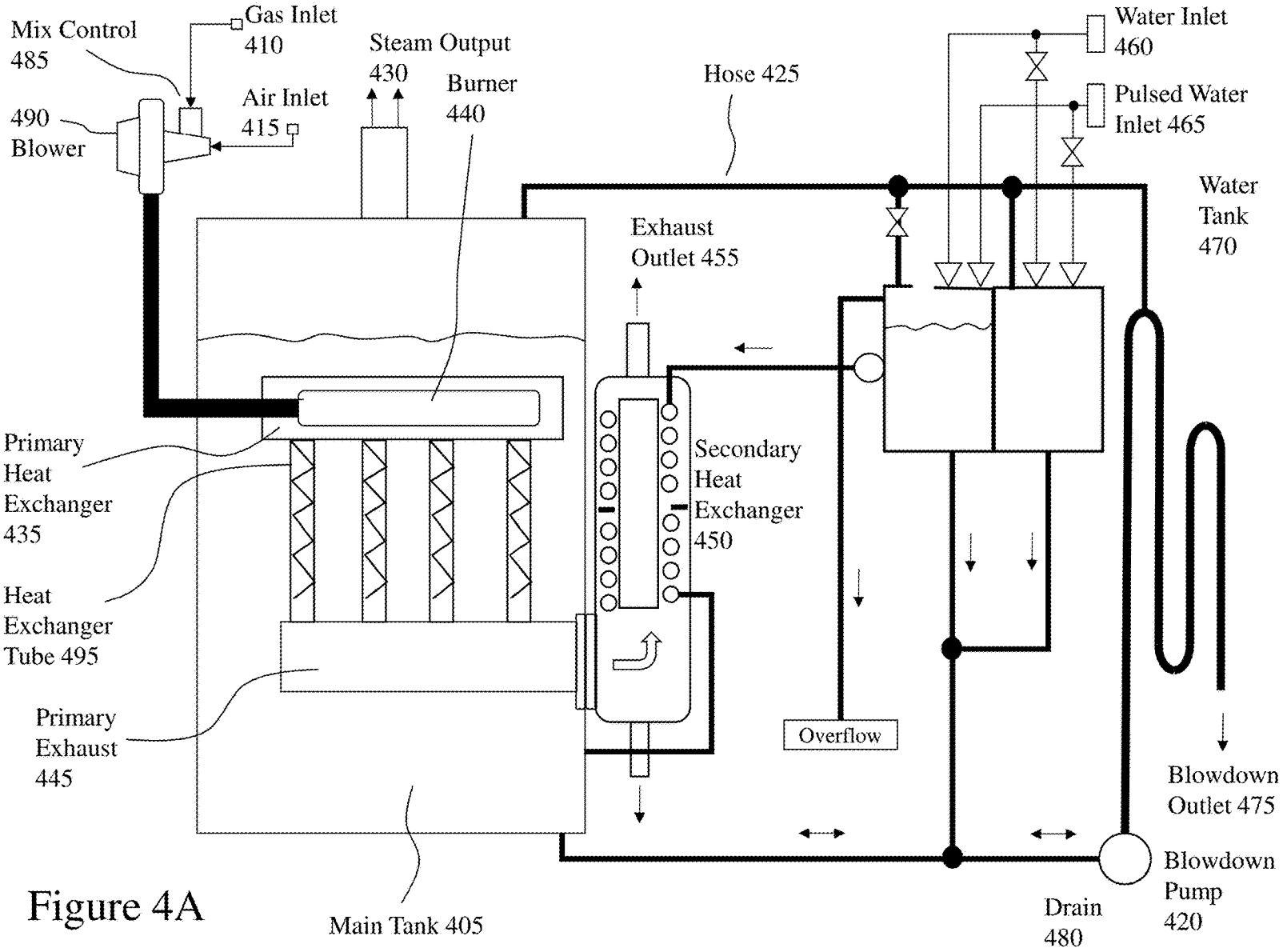
FIG. 4A depicts a schematic of a compact high efficiency humidifier exploiting embodiments of the invention.

Accordingly, referring to FIG. 4A a schematic of a dual-stage humidifier according to an embodiment of the invention is depicted such as the humidifiers of CS/NX series depicted in FIGS. 1 to 3 respectively. Accordingly, as depicted there are a first fluidic circuit relating to the combustion of an energy source, e.g. gas, and a second fluidic circuit relating to the humidification via the primary heat exchanger (PRI-HEX) 435, exhaust gas cooling via the secondary heat exchanger (SEC-HEX) 450, and associated fill, drain and blowdown functions. Accordingly, the first fluidic circuit relating to the combustion begins with an Air Inlet 415 and Gas Inlet 410 which are coupled to a blower 490. The Gas Inlet 410 via a Mix Control 485 to ensure consistent air-gas ratio for high efficiency consumption with low soot etc. The output of the Blower 490 is coupled to the Burner 440 within the PRI-HEX 435 wherein combustion occurs and the hot combusted gases are coupled from the PRI-HEX 435 to the Primary Exhaust 445 via Heat Exchanger Tubes (HEX-Tubes) 495. From the Primary Exhaust 445 the partially cooled combustion gases due to conduction heat transfer to the water within the Main Tank 405 surrounding the PRI-HEX 435, HEX-Tubes 495, and Primary Exhaust 445 exit the humidifier in a standard efficiency humidifier.

The Primary Exhaust 445 is coupled to the Secondary Heat Exchanger (SEC-HEX) 450 where further heat exchange occurs, but now to water that is fed from the Water Tank 470 through the SEC-HEX 450 to the Main Tank 405 surrounding the PRI-HEX 435, HEX-Tubes 495, and Primary Exhaust 445. The now cooler exhaust is released to atmosphere (the environment) at Exhaust Outlet 455.

The second fluidic circuit begins essentially with the Water Tank 470 which is filled via a Water Inlet 460 and a Pulsed Water Inlet 465. As will be discussed below the Water Inlet 460 is employed for "coarse" water actions such as initial fill, blowdown etc. whereas the Pulsed Water Inlet 465 is employed during "fine" water actions of the humidifier when a demand is present, e.g. a demand for steam. The Water Tank 470 is coupled directly to the Main Tank 405 for "coarse" filling such as the initial fill operation. This connection is also coupled to the Drain 480 and Blowdown Outlet 475. The former Drain 480 allows the Water Tank 470 and Main Tank 405 to be drained directly to a municipal sewer, another tank, etc. The Blowdown Outlet 475 is employed during a blowdown sequence within the humidifier wherein the Main Tank 405 is drained through a pumping sequence rather than simple gravity drain via the action of Blowdown Pump 420 which pumps the water from the Main Tank 405 to the Blowdown Outlet 475. A blowdown processes allows for excess dissolved minerals accumulated inside the Main Tank 405 to be removed and extracted from the water to prevent excessive fouling of heat exchange surfaces due to mineral buildup.

Figure 5:
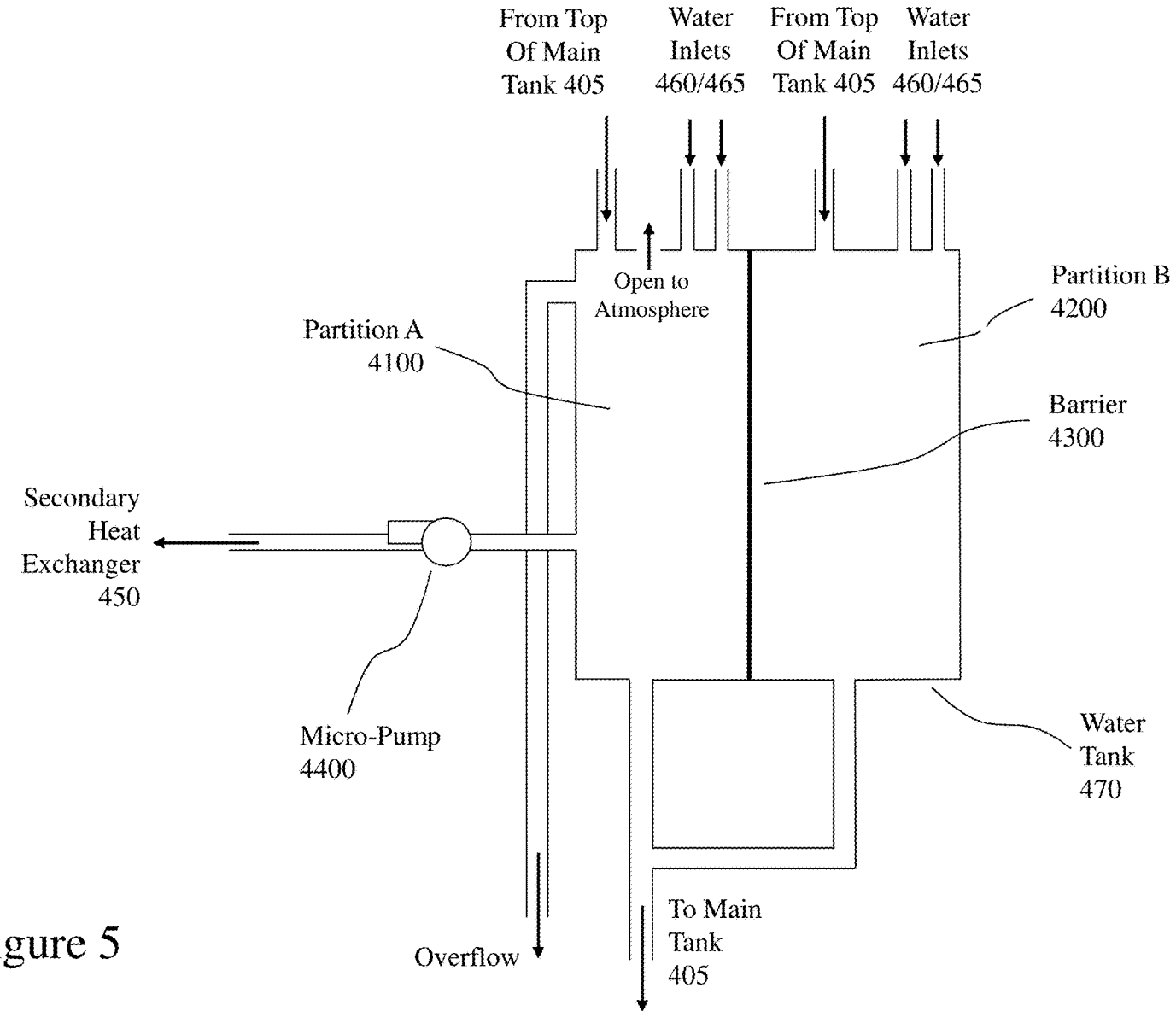
FIG. 5 depicts a schematic of a fill box for a compact high efficiency humidifier exploiting embodiments of the invention.
Figure 6:
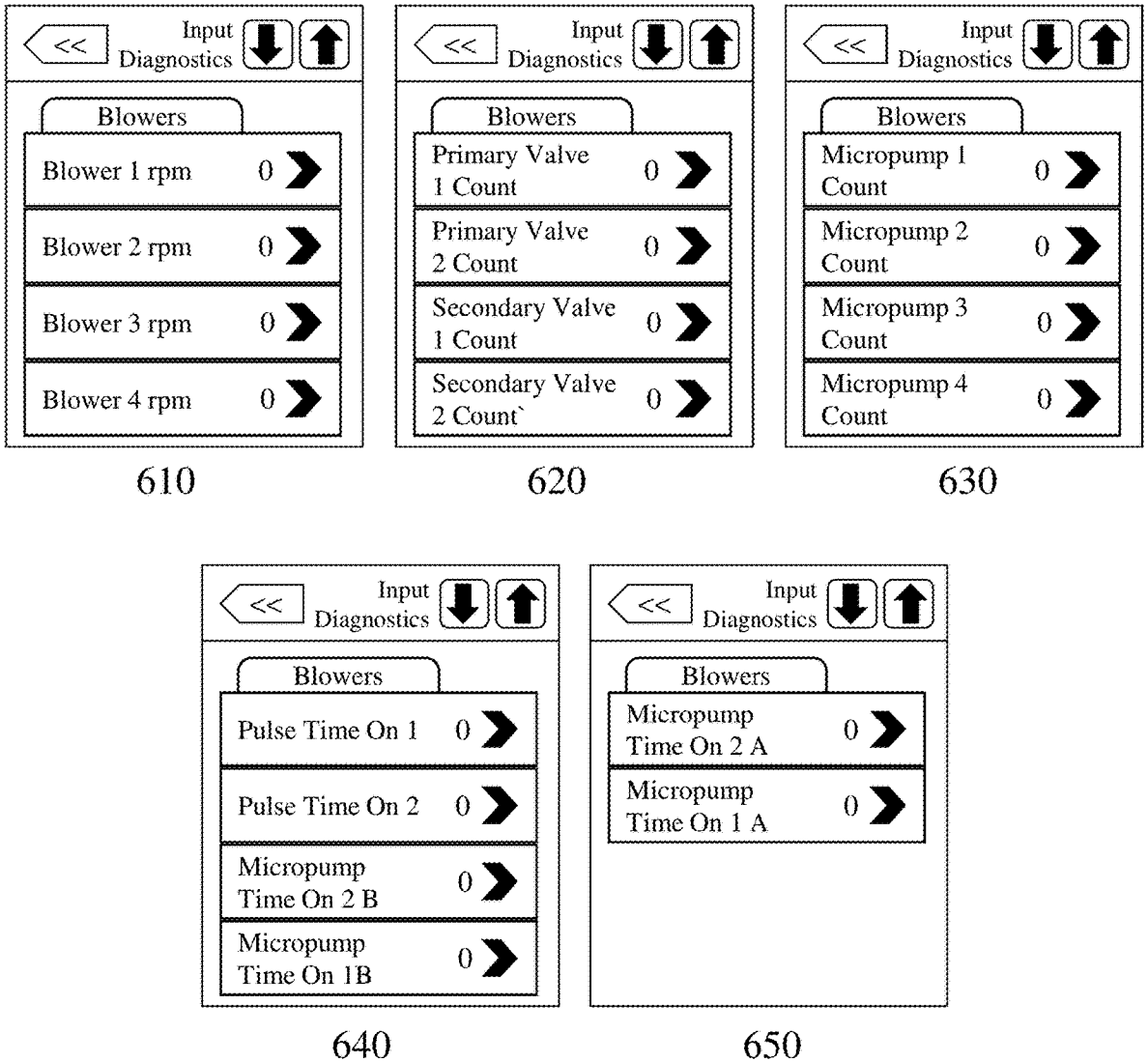
FIG. 6 depict exemplary display screens of a control interface for a compact high efficiency humidifier exploiting embodiments of the invention.

The Water Tank 470 is also connected to the upper region of the Main Tank 405 which is open to atmospheric pressure via the air conditioning system attached to the Steam Output 430. In this manner the Water Tank 470 is maintained at equal pressure to the Main Tank 405. As depicted in FIG. 5 the Water Tank 470 is partitioned into Partition A 4100 and Partition B 4200 with Barrier 4300 disposed between them. The connection from Partition A 4100 to SEC-HEX 450 is via a Micropump 4400. As depicted in FIG. 5 Partition A is open to atmosphere to allow an air gap between the fill lines and the water in the tank. The air gap is maintained in all cases by an overflow line which goes to drain in case the water level reaches its level. Partition B 4200 is sealed and connected to the top of the main tank with one connection at the top and to the bottom with another. Within other embodiments of the invention the Barrier 4300 may, for example, be a wall to each partition with a 1" (25 mm) air gap between them although other structures may be employed with departing from the scope of the invention.

Figure 4C:
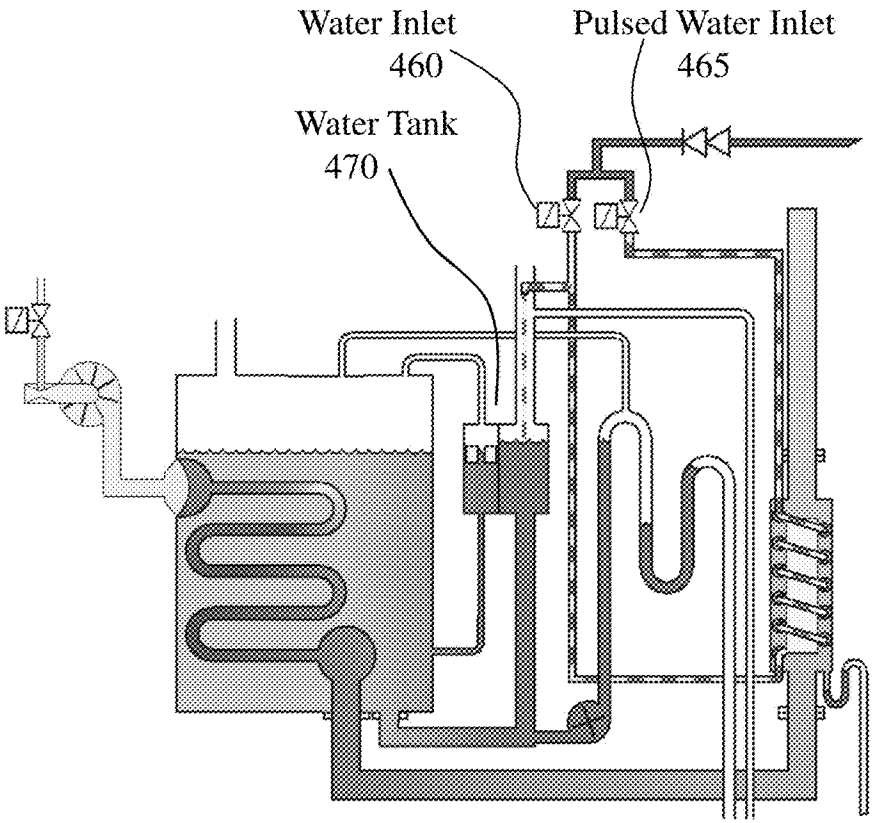
FIGS. 4B and 4C schematics of humidifier variants according to embodiments of the invention comprising a condensing humidifier with micropump and a condensing humidifier without micropump respectively.
Figure 4B:
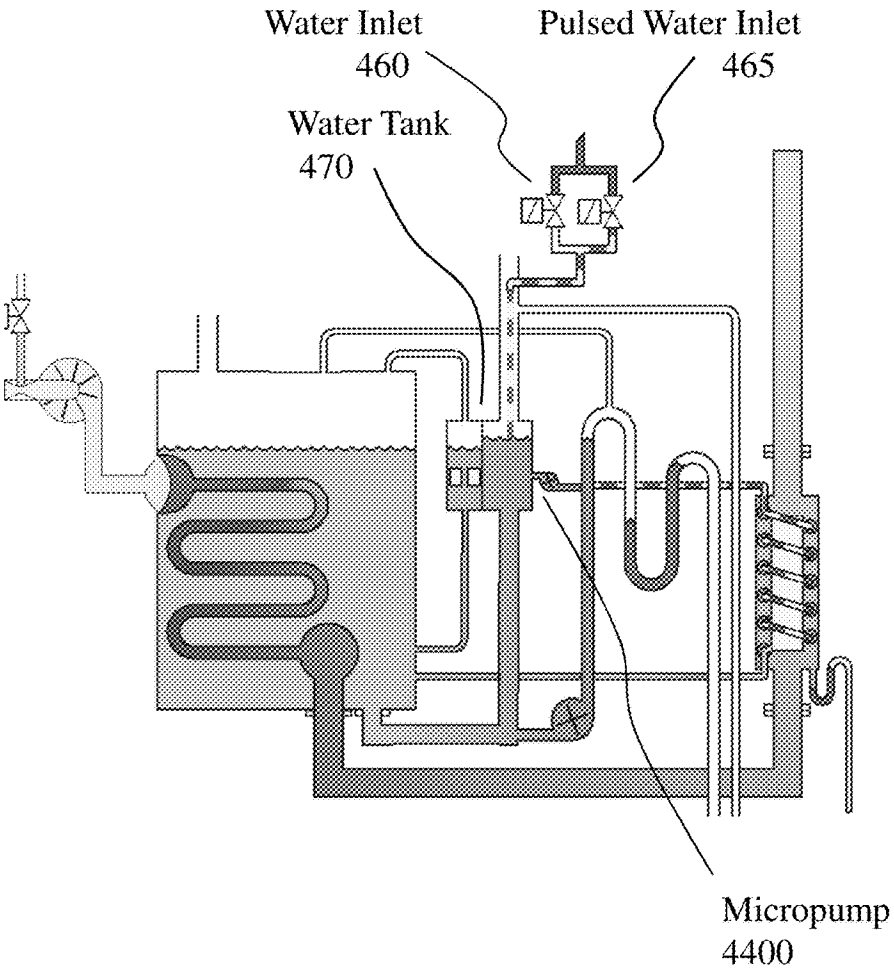

Now referring to FIGS. 4B and 4C respectively there are depicted condensing humidifier designs with and without micropump 4400. In FIG. 4B as with FIG. 4A the water tank is coupled to Water Inlet 460 and Pulsed Water Inlet 465 and the condenser on the second stage heat exchanger is coupled to the Water Tank 470 via Micropump 4400. However, in FIG. 4C the Micropump 4400 is omitted and whilst Water Inlet 460 still couples directly to the Water Tank 470 the Pulsed Water Inlet 465 is now coupled to the Water Tank 470 via the secondary heat exchanger. Optionally, in each instance rather than a Pulsed Water Inlet 465 the pump and/or valve on that inlet may be modulated rather than pulsed in order to adjust the overall flow rate.

The control software through a graphical user interface forming part of the humidifier provides access to a range of control parameters for the dual stage humidifier but it also allows access to a Service menu which provides a user with access to aspects such as Humidifier Service, General Service, Fault Service History, and Diagnostics. Through the Diagnostics sub-menus accessed through the Service Menu option the user can access diagnostics relating to the blowers within the humidifier. As such these are presented to the user as first to fifth Input Diagnostics Blower Sub-Menu (INDI-SUB) 610 to 650 respectively, wherein

- First INDI-SUB 610 relating to Blower 1 rpm, Blower 2 rpm, Blower 3 rpm, and Blower 4 rpm;
- Second INDI-SUB 620 relating to Primary Valve 1, Primary Valve 2, Secondary Valve 1, and Secondary Valve 2;
- Third INDI-SUB 630 relating to Micropump 1, Micropump 2, Micropump 3, and Micropump 4;
- Fourth INDI-SUB 640 relating to Pulse Time On 1, Pulse Time On 2, Micropump Time On 2B, and Micropump Time On 1B; and
- Fifth INDI-SUB 650 relating to Micropump Time On 2A, and Micropump Time On 1A.

Accordingly, the control software executed upon an integrated controller in addition to providing a user access to many conventional control aspects of the humidifier the control software also supports fine tuning of 1) pulse rate of the low flow inlet valve; 2) pulse rate of the micropump; and 3) flow rate of the micropump in order to ensure proper cooling of the exhaust gases from the dual stage humidifier is achieved.

Accordingly, through the control software and the diagnostics sub-menus a user is able to adjust the settings of the valves and pumps associated with Water Tank 470 and its 4 connections to the humidifier overall both inlets and outlets. However, normally a humidifier according to an embodiment of the invention would operate using the factory installed settings for these different controls which may be constant or vary according to the demand placed on the humidifier. These arise when seeking to ensure high efficiency operation as during operation at different demand levels of steam from the humidifier different effects within the humidifier must be factored into the control settings to ensure that not only is the overall efficiency maintained but that all other aspects of the humidifier specification are maintained.

For example, at low demand the overall control system must account for an increasing water temperature within the Water Tank 470 which accordingly reduces the efficiency of the SEC-HEX and hence the exhaust outlet temperature would increase but this cannot exceed the maximum rated exhaust and accordingly at low demand the control system must ensure that the temperature of the water not increase too much which means increasing cold water inlet flow and flow but this cannot be arbitrarily increased at low demand as the temperature of the water within the main tank will reduce thereby reducing its efficiency. In contrast, at high demand with both increased energy to be absorbed from the exhaust gases and generated steam to be replaced the initial response is to increase the flow rate from the Water Tank 470 to the main tank through the SEC-HEX. However, again increasing the water flow too far results in cooler water flowing into the main tank reducing its efficiency.

Accordingly, the inventors have established an advanced control algorithm to address the different conflicting demands of high efficiency steam generation at varying demand and exhaust gas upper temperature limit. The inventors have employed micropumps with variable pulse rates and pulse width modulation to provide the required control levels at the lowest flow rates.

An example of this is presented below in Table 5 with respect to fill water management based upon the float board inputs as presented above and in respect of Table 4.

TABLE 5

Fill Water Management

| | | All Units | | | |
|---|---|---|---|---|---|
| Float Board Input | Software Water Level | Primary Fill Valve(s) Response | Secondary Fill Valve(s) Response | CS/NX Units Modulating Pump(s) | Burner/ Blower Operation |
| None | 0 | ON—continuous | OFF | OFF | Not Permitted |
| Low Only | 1 | ON—continuous | OFF | OFF | Not Permitted |
| Low + Mid | 2 | ON—continuous | OFF | On—Pulsed Mode (1) | Permitted |
| Mid Only | 3 | OFF | On—Pulsed Mode (1) | On—Pulsed Mode (1) | Permitted |
| Mid + High | 4 | OFF | On—Pulsed Mode (1) | On—Pulsed Mode (1) | Permitted |
| High Only | 5 | OFF | On—Pulsed Mode (1) | On—Pulsed Mode (1) | Permitted |

Note 1:
If blowers active, based on number of burners required

Pulse filling is controlled by an off time ($SVT_{OFF}(X)$, X=1,2) and an on time ($SVT_{ON}(X)$, X=1,2). Within an embodiment of the invention the off time is a constant whilst the on time is calculated based upon demand, blowdown, burner capacity, number of active burners and fill correction values. An example of the calculation for $SVT_{ON}(X)$ is given by Equation (1) below.

$$SVT_{ON}(X) = (FILL_{CORR}(X) \times \frac{SVT_{OFF}(X)}{\left(\frac{SV_{RATE}(X)}{REQ_{RATE}(X)}\right) - 1} \tag{1}$$

$$REQ_{RATE}(X) = \left(\frac{BL_{CAPACITY} \times N_{BURNERS} \times \text{Demand}}{100}\right) \times \left(1 + \frac{BD_{RATE}}{100}\right) \times \left(\frac{Burn_1 + Burn_2}{REQ_{BURN-ON}}\right) \tag{2}$$

The micropumps are activated according to the number of burners so MicroPump(X)=ON when Burner(X)=ACTIVE for $1 \leq X \leq 4$. Each pump is cycled on and off with, for example, a fixed off time MicroPump−$Time_{OFF}$ and a calculated on time MicroPump−$Time_{ON}$ which changes based upon demand, blowdown, burner capacity and number of active burners. Each micropump is controlled through a pulse width modulated (PWM) control signal when on and PWM=0 during off time. The micropump timing is given by Equation (3).

$$MicroPump-Time_{ON}=\frac{MicroPump-Time_{OFF}}{\left(\frac{\text{MicroPump_Rate}}{REQ_{RATE}(MicroPump)}\right)-1} \quad (3)$$

$$REQ_{RATE}(MicroPump)=\left(\frac{BL_{CAPACITY}\times N_{BURNERS}\times \text{Demand}}{100}\right)\times\left(1+\frac{BD_{RATE}}{100}\right)\times\left(\frac{1}{REQ_{BURN-ON}}\right) \quad (4)$$

Figure 7:
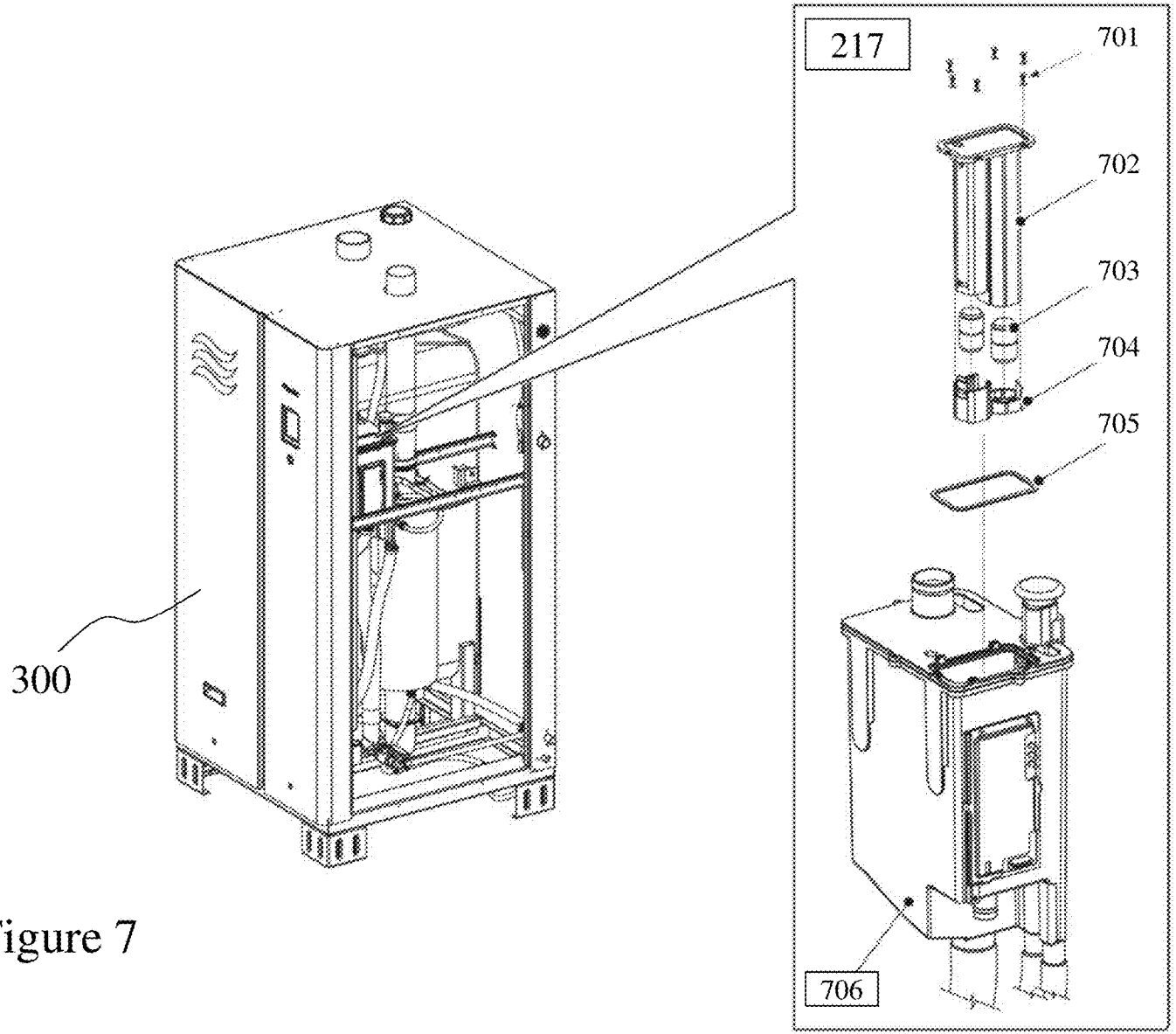
FIG. 7 depicts the float assembly within a fill box of a compact high efficiency humidifier exploiting embodiments of the invention.

Now referring to FIG. 7 there is depicted a schematic of a Fill Box 217 as depicted in FIG. 2 according to an embodiment of the invention within a Humidifier 300. Accordingly, the Fill Box 217 comprises a Fill Box Body 706 into which is inserted a Float Sleeve 702 via Screws 701. Within each tube of the Float Sleeve 702 a Magnetic Float 703 is disposed and the tube ends capped with Cap End 704. A Gasket 705 provides a seal between the upper portion of the Float Sleeve 702 and the Fill Box Body 706. As depicted the Float Sleeve 702 is disposed within Partition B 4200 of the Fill Box 217.

According to an embodiment of the invention a call for humidity when the humidifier changes from an idle to humidifying state then the primary fill valves are energized for a predetermined duration in order to flush and cool off the Fill Box 217. At a predetermined point after starting the primary fill valves the micropumps are actuated to flush the SEC-HEX. After this the normal water management process takes over.

Within a humidifier according to an embodiment of the invention when the drain pump is activated, the fill valve may also be activated to cool the drain water to an acceptable temperature to meet local plumbing requirements. Optionally, a humidifier design may allow for the drain cooling to be undertaken using a water source that is separate from the humidifier water supply.

According to an embodiment of the invention then a humidifier may be implemented with the following design guidelines.

| | | | |
|---|---|---|---|
| Gas Inlet | 132 kBTU/h | | |
| Air Inlet | 28.6 cfm | | |
| Steam | 100 lb/h | Q = 97,000 BTU/h | 212 F. |
| Combustion Gases | ΔT = 2550 F. (2900-350) | Q = xx BTU/h | |
| Main Tank | 125 lb/h | Q = 6,250 BTU/h | ΔT = 50 F. (212-162) |
| Exhaust Outlet | 170 F. | 30 cfm | |
| Flue Condensate | 170 F. | 6 lb/h | |
| SEC-HEX | Stages 1 & 2 | Water ΔT = 120 F. (170-50) Flue Gas ΔT = 180 F. (350-170) | Q = 14,000 BTU/h |

Specific details are given in the above description to provide a thorough understanding of the embodiments. However, it is understood that the embodiments may be practiced without these specific details. For example, circuits may be shown in block diagrams in order not to obscure the embodiments in unnecessary detail. In other instances, well-known circuits, processes, algorithms, structures, and techniques may be shown without unnecessary detail in order to avoid obscuring the embodiments.

Implementation of the techniques, blocks, steps and means described above may be done in various ways. For example, these techniques, blocks, steps and means may be implemented in hardware, software, or a combination thereof. For a hardware implementation, the processing units may be implemented within one or more application specific integrated circuits (ASICs), digital signal processors (DSPs), digital signal processing devices (DSPDs), programmable logic devices (PLDs), field programmable gate arrays (FPGAs), processors, controllers, micro-controllers, microprocessors, other electronic units designed to perform the functions described above and/or a combination thereof.

Also, it is noted that the embodiments may be described as a process which is depicted as a flowchart, a flow diagram, a data flow diagram, a structure diagram, or a block diagram. Although a flowchart may describe the operations as a sequential process, many of the operations can be performed in parallel or concurrently. In addition, the order of the operations may be rearranged. A process is terminated when its operations are completed, but could have additional steps not included in the figure. A process may correspond to a method, a function, a procedure, a subroutine, a subprogram, etc. When a process corresponds to a function, its termination corresponds to a return of the function to the calling function or the main function.

Furthermore, embodiments may be implemented by hardware, software, scripting languages, firmware, middleware, microcode, hardware description languages and/or any combination thereof. When implemented in software, firmware, middleware, scripting language and/or microcode, the program code or code segments to perform the necessary tasks may be stored in a machine readable medium, such as a storage medium. A code segment or machine-executable instruction may represent a procedure, a function, a subprogram, a program, a routine, a subroutine, a module, a software package, a script, a class, or any combination of instructions, data structures and/or program statements. A code segment may be coupled to another code segment or a hardware circuit by passing and/or receiving information, data, arguments, parameters and/or memory content. Information, arguments, parameters, data, etc. may be passed, forwarded, or transmitted via any suitable means including memory sharing, message passing, token passing, network transmission, etc.

For a firmware and/or software implementation, the methodologies may be implemented with modules (e.g., procedures, functions, and so on) that perform the functions described herein. Any machine-readable medium tangibly embodying instructions may be used in implementing the methodologies described herein. For example, software codes may be stored in a memory. Memory may be implemented within the processor or external to the processor and may vary in implementation where the memory is employed in storing software codes for subsequent execution to that when the memory is employed in executing the software codes. As used herein the term "memory" refers to any type of long term, short term, volatile, nonvolatile, or other storage medium and is not to be limited to any particular type of memory or number of memories, or type of media upon which memory is stored.

Moreover, as disclosed herein, the term "storage medium" may represent one or more devices for storing data, including read only memory (ROM), random access memory (RAM), magnetic RAM, core memory, magnetic disk storage mediums, optical storage mediums, flash memory devices and/or other machine readable mediums for storing information. The term "machine-readable medium" includes, but is not limited to portable or fixed storage devices, optical storage devices, wireless channels and/or various other mediums capable of storing, containing or carrying instruction(s) and/or data.

The methodologies described herein are, in one or more embodiments, performable by a machine which includes one or more processors that accept code segments containing instructions. For any of the methods described herein, when the instructions are executed by the machine, the machine performs the method. Any machine capable of executing a set of instructions (sequential or otherwise) that specify actions to be taken by that machine are included. Thus, a typical machine may be exemplified by a typical processing system that includes one or more processors. Each processor may include one or more of a CPU, a graphics-processing unit, and a programmable DSP unit. The processing system further may include a memory subsystem including main RAM and/or a static RAM, and/or ROM. A bus subsystem may be included for communicating between the components. If the processing system requires a display, such a display may be included, e.g., a liquid crystal display (LCD). If manual data entry is required, the processing system also includes an input device such as one or more of an alphanumeric input unit such as a keyboard, a pointing control device such as a mouse, and so forth.

The memory includes machine-readable code segments (e.g. software or software code) including instructions for performing, when executed by the processing system, one of more of the methods described herein. The software may reside entirely in the memory, or may also reside, completely or at least partially, within the RAM and/or within the processor during execution thereof by the computer system. Thus, the memory and the processor also constitute a system comprising machine-readable code.

In alternative embodiments, the machine operates as a standalone device or may be connected, e.g., networked to other machines, in a networked deployment, the machine may operate in the capacity of a server or a client machine in server-client network environment, or as a peer machine in a peer-to-peer or distributed network environment. The machine may be, for example, a computer, a server, a cluster of servers, a cluster of computers, a web appliance, a distributed computing environment, a cloud computing environment, or any machine capable of executing a set of instructions (sequential or otherwise) that specify actions to be taken by that machine. The term "machine" may also be taken to include any collection of machines that individually or jointly execute a set (or multiple sets) of instructions to perform any one or more of the methodologies discussed herein.

The foregoing disclosure of the exemplary embodiments of the present invention has been presented for purposes of illustration and description. It is not intended to be exhaustive or to limit the invention to the precise forms disclosed. Many variations and modifications of the embodiments described herein will be apparent to one of ordinary skill in the art in light of the above disclosure. The scope of the invention is to be defined only by the claims appended hereto, and by their equivalents.

Further, in describing representative embodiments of the present invention, the specification may have presented the method and/or process of the present invention as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process of the present invention should not be limited to the performance of their steps in the order written, and one skilled in the art can readily appreciate that the sequences may be varied and still remain within the spirit and scope of the present invention.

What is claimed is:

1. A humidifier comprising:

a burner for burning a fuel within a water tank for generating steam in response to a demand;

a primary heat exchanger within the water tank for transferring heat from products of combustion of the fuel to the water within the water tank;

a secondary heat exchanger comprising a combusted gas section coupled to primary heat exchanger for receiving the cooled products of combustion from the primary heat exchanger and a water section for transferring additional heat from the cooled products of combustion at an output of the primary heat exchanger to water flowing within the secondary heat exchanger from a fill box to the water tank;

the fill box comprising:

a first water tank chamber coupled to a primary water fill from an external water source via a primary water fill valve;

a first outlet coupled from the first water tank chamber to the secondary heat exchanger via a micropump;

a second outlet coupled to a drain via a drain valve, wherein the drain is also coupled to the bottom of the water tank;

a second water tank chamber coupled to a bottom section of the first water tank chamber; and a third outlet coupled to an upper section of the water tank to maintain pressure balance between the water tank and first water tank chamber; and a plurality of floats disposed within the second water tank chamber, each float of the plurality of floats for detecting a different water level within the second water tank chamber;

wherein an outlet of the secondary heat exchanger is fed directly into the water tank.

2. The humidifier according to claim 1, wherein the primary water fill valve is either:

a modulating valve wherein a modulation rate of the modulating valve adjusts the net flow rate from the primary water fill valve; or a pulsed valve wherein varying a pulse mark-space ratio of the pulsed valve adjusts the net flow rate from the primary water fill valve.

3. The humidifier according to claim 1, further comprising a secondary water fill valve coupled to the first water tank chamber with a lower flow rate than the primary water fill valve;

wherein the secondary water fill valve is at least one of pulsed and modulated to maintain cool water in the first water tank chamber.

4. The humidifier according to claim 3, wherein a first float of the plurality of floats establishes a lowest fill level;

a second float of the plurality of floats establishes a highest fill level;

a third float of the plurality of floats establishes a middle fill level between the lowest fill level and the highest fill level;

the primary fill valve is triggered when the detected water level drops below the middle fill level; and the secondary fill valve maintains the water level between the middle fill level and the highest fill level.

5. The humidifier according to claim 1, further comprising a drain port on the secondary heat exchanger for draining condensate from combusted gas section.

6. The humidifier according to claim 1, further comprising a controller coupled to at least the micropump, wherein the controller adjusts the operation of the micropump in response to the demand for steam from the humidifier.

7. The humidifier according to claim 1, wherein when the humidifier transitions from an idle state to a humidifying state the primary fill valve is opened for a predetermined period of time to cool the fill box.

8. The humidifier according to claim 1, wherein the primary heat exchanger is one of multiple primary heat exchangers and the secondary heat exchanger is one of multiple secondary heat exchangers and the multiple primary heat exchangers and the multiple secondary heat exchangers are connected to a single main water tank with a single steam outlet, wherein the outlet from each primary heat exchanger of the multiple heat exchangers is connected to a predetermined secondary heat exchanger of the multiple heat exchangers and the outlets of the multiple secondary heat exchangers are combined into a single outlet; and cooling water for each secondary heat exchanger of the multiple secondary heat exchangers is supplied from a single fill box via a predetermined micropump of a plurality of micropumps.

9. The humidifier according to claim 1, further comprising a second fill box for providing cooling water to the secondary heat exchangers; and the water level within the fill box feeding the water tank is detected through a separate float chamber coupled to the second water tank chamber of the fill box.

10. The humidifier according to claim 1, wherein a valve is used to control flow from the fill box to the secondary heat exchanger in place of a micropump.

11. The humidifier according to claim 1, wherein the primary heat exchanger is one of multiple primary heat exchangers each connected to the secondary heat exchanger.

12. The humidifier according to claim 1, wherein the micropump is controlled by a control algorithm in execution upon a controller of the humidifier in dependence upon a demand for steam from the humidifier and a maximum upper temperature limit for the cooled products of combustion at an output of the primary heat exchanger.

13. The humidifier according to claim 1, wherein a first float of the plurality of floats establishes a lowest fill level;

a second float of the plurality of floats establishes a highest fill level;

a third float of the plurality of floats establishes a middle fill level between the lowest fill level and the highest fill level;

the primary fill valve is triggered to allow water to flow in when the detected water level drops below the middle fill level.

14. A humidifier comprising:

a burner for burning a fuel within a water tank for generating steam in response to a demand;

a primary heat exchanger within the water tank for transferring heat from products of combustion of the fuel to the water within the water tank;

a secondary heat exchanger comprising a combusted gas section coupled to primary heat exchanger for receiving the cooled products of combustion from the primary heat exchanger and a water section for transferring additional heat from the cooled products of combustion to water flowing within the secondary heat exchanger from a fill box to the water tank; and a secondary fill valve connected to the secondary heat exchanger which is pulsed to provide cool water for transferring additional heat from the cooled products of combustion to water flowing within the secondary heat exchanger; wherein the fill box comprises:

a first water tank chamber coupled to a primary water fill from an external water source via a valve;

a first outlet coupled to a drain via a drain valve, the drain also coupled the bottom of the water tank;

a first inlet to the first water tank chamber coupled to the outlet of the secondary heat exchanger;

a second water tank chamber coupled to the bottom section of the first water tank chamber;

a plurality of floats which are used to control water level in the water tank;

a second outlet coupled to the upper section of the water tank to maintain pressure balance between the water tank and first water tank chamber;

wherein an outlet of the secondary heat exchanger is fed directly into the water tank.

15. The humidifier according to claim 14, wherein the secondary water fill valve is either:

a modulating valve wherein a modulation rate of the modulating valve adjusts the net flow rate from the primary water fill valve; or a pulsed valve wherein varying a pulse mark-space ratio of the pulsed valve adjusts the net flow rate from the primary water fill valve.

16. The humidifier according to claim 14, wherein control of the secondary heat exchanger is established in dependence upon a plurality of water levels established by the plurality of floats.

17. A humidifier comprising:

a burner for burning a fuel within a water tank for generating steam in response to a demand;

a primary heat exchanger within the water tank for transferring heat from products of combustion of the fuel to the water within the water tank;

a secondary heat exchanger comprising a combusted gas section coupled to primary heat exchanger for receiving the cooled products of combustion from the primary heat exchanger and a water section for transferring additional heat from the cooled products of combustion to water flowing within the secondary heat exchanger; and a secondary fill valve connected to the secondary heat exchanger which is pulsed to provide cool water for transferring additional heat from the cooled products of combustion to water flowing within the secondary heat exchanger; wherein the water from a primary fill valve is fed directly into the water tank; and an outlet of the secondary heat exchanger is fed directly into the water tank.

* * * * *